US009540953B2

(12) United States Patent
Weidmann

(10) Patent No.: US 9,540,953 B2
(45) Date of Patent: Jan. 10, 2017

(54) HOUSING-SIDE STRUCTURE OF A TURBOMACHINE

(75) Inventor: Wilfried Weidmann, Erdweg (DE)

(73) Assignee: MTU Aero Engines GmbH, Munich (DE)

( * ) Notice: Subject to any disclaimer, the term of this patent is extended or adjusted under 35 U.S.C. 154(b) by 723 days.

(21) Appl. No.: 13/819,531

(22) PCT Filed: Aug. 29, 2011

(86) PCT No.: PCT/DE2011/001667

§ 371 (c)(1),
(2), (4) Date: Feb. 27, 2013

(87) PCT Pub. No.: WO2012/028140

PCT Pub. Date: Mar. 8, 2012

(65) Prior Publication Data

US 2013/0183149 A1 Jul. 18, 2013

(30) Foreign Application Priority Data

Sep. 1, 2010 (DE) ..... 10 2010 036 071

(51) Int. Cl.
*F01D 25/24* (2006.01)
*F01D 11/18* (2006.01)
*F04D 29/52* (2006.01)

(52) U.S. Cl.
CPC ..... *F01D 25/24* (2013.01); *F01D 11/18* (2013.01); *F04D 29/522* (2013.01); *F05D 2240/11* (2013.01); *F05D 2260/94* (2013.01); *F05D 2260/941* (2013.01)

(58) Field of Classification Search
CPC ..... F01D 11/18; F01D 25/24; F04D 29/522; F05D 2240/11; F05D 2260/94; F05D 2260/941
See application file for complete search history.

(56) References Cited

U.S. PATENT DOCUMENTS 3,825,364 A * 7/1974 Halila ..... F01D 11/12 165/907
4,805,398 A * 2/1989 Jourdain ..... F01D 5/082 236/93 R
5,080,557 A 1/1992 Berger
2004/0033133 A1* 2/2004 Muny ..... F01D 25/246 415/175

(Continued)

FOREIGN PATENT DOCUMENTS

DE 102004037955 A1 3/2006
EP 1475515 A2 11/2004

(Continued)

*Primary Examiner* — Thomas Denion
*Assistant Examiner* — Brandon Lee
(74) *Attorney, Agent, or Firm* — Davidson, Davidson & Kappel, LLC

(57) ABSTRACT

A housing-side structure of a turbomachine, in particular of a gas turbine, including an in particular segmented jacket ring (16), which carries an abradable lining for radially outer ends of rotor-side moving blades of a moving blade ring, wherein the jacket ring (16) carrying the abradable lining is connected by means of at least one constriction (18) to a stator-side housing part (19), which is radially adjacent to the jacket ring (16) on the outside and the jacket ring is thermally decoupled from said stator-side housing.

18 Claims, 3 Drawing Sheets

(56) References Cited

U.S. PATENT DOCUMENTS

| | | | | |
|---|---|---|---|---|
| 2005/0232759 | A1 | 10/2005 | Bailleul | |
| 2006/0245924 | A1* | 11/2006 | Audeon | F01D 11/005 415/214.1 |
| 2008/0267768 | A1 | 10/2008 | Dakowski et al. | |
| 2011/0236203 | A1 | 9/2011 | Arilla et al. | |

FOREIGN PATENT DOCUMENTS

| | | | |
|---|---|---|---|
| EP | 1717418 | A1 | 11/2006 |
| EP | 1965027 | A2 | 9/2008 |
| FR | 2938873 | A1 | 5/2010 |
| GB | 2117843 | A | 10/1983 |
| WO | WO 95/25879 | A1 | 9/1995 |
| WO | WO 2004/101958 | A1 | 11/2004 |

* cited by examiner

HOUSING-SIDE STRUCTURE OF A TURBOMACHINE

The present invention relates to a housing-side structure of a turbomachine. In addition, the present invention relates to a turbomachine.

BACKGROUND

DE 10 2004 037 955 A1 describes a turbomachine having a stator and a rotor, the rotor having moving blades and the stator having a housing and guide blades. The rotor-side moving blades form at least one moving blade ring, which is adjacent to a radially inner housing wall of the housing on a radially outer end, is surrounded by same, and restrains a radial clearance with same. The radially inside housing wall of the housing is also referred to as the inner ring or the jacket ring and functions in particular as a carrier for an abradable lining. The inner ring or jacket ring of a compressor or a turbine may be segmented and may thus be composed of multiple jacket ring segments; a jacket ring segment may also be referred to as a shroud. It is also known from DE 10 2004 037 955 A1 that the clearance between the jacket ring of the housing and the radially outer end of the/each moving blade ring may be adjusted or adapted to provide a so-called active clearance control via control elements in its clearance, to thereby automatically influence the clearance and ensure an optimum clearance control and thus an optimum surge margin and optimum efficiency across all operating conditions. According to this prior art, a control element, preferably designed as electromechanical actuators, is assigned to each jacket ring segment of the jacket ring. An active clearance control principle may thus be provided in this way.

SUMMARY OF THE INVENTION

The clearance control of the clearance between the radially outer ends of the moving blades of a moving blade ring and the inner ring or jacket ring of the housing via active clearance control is structurally complex. It is therefore desirable to implement the clearance control with little complexity.

It is an object of the present invention to provide a housing-side structure of a turbomachine, which allows a novel and simple clearance control principle. The present invention provides a housing-side structure of a turbomachine so that a jacket ring carrying the abradable lining is connected via at least one constriction to a stator-side housing part, which is radially adjacent to the jacket ring on the outside and is thermally decoupled from same.

With the housing-side structure of a turbomachine according to the present invention, thermal overshooting is reduced as a result of thermal decoupling of the jacket ring or inner ring from the radially adjacent outside housing, in particular in transient operating ranges of the turbomachine during acceleration or deceleration of same, making it possible to improve clearance control between the moving blade ring and the jacket ring radially adjacent to the moving blade ring on the outside. The thermal decoupling is achieved via at least one constriction between the jacket ring and the housing part radially adjacent to same on the outside. An inexpensive, weight-optimized, reliable and simple compact design may be achieved through the design principle of a housing-side structure of a turbomachine according to the present invention, which is used in high-pressure compressors in particular. With this design, it is possible to achieve clearance control between the radially outer ends of the moving blades of a moving blade ring and a radially adjacent jacket ring on the outside, and thus an optimal surge margin and optimal efficiency may be provided without complex active clearance control.

According to one advantageous refinement of the present invention, a flange is formed on the stator-side housing part radially adjacent to the jacket ring on the outside, so that a supporting element which is attached to the flange is preferably in contact with a downstream end of the jacket ring for stabilization of same in at least one section. The supporting element secures the jacket ring against tilting and thereby stabilizes it. In addition, the supporting element which comes to rest on a downstream end of the jacket ring also assumes a sealing function.

A heat shield preferably prevents a hot gas inflow into a housing-side recess. The heat shield may further improve the clearance control.

BRIEF DESCRIPTION OF THE DRAWINGS

Preferred refinements of the present invention are derived from the subclaims and the following description. Exemplary embodiments of the present invention are described in greater detail with reference to the drawings although without being limited thereto.

DETAILED DESCRIPTION

The present invention here relates to a housing-side structure of a turbomachine, in particular a gas turbine. The present invention is used in compressors in particular, preferably in high-pressure compressors.

Figure 1:
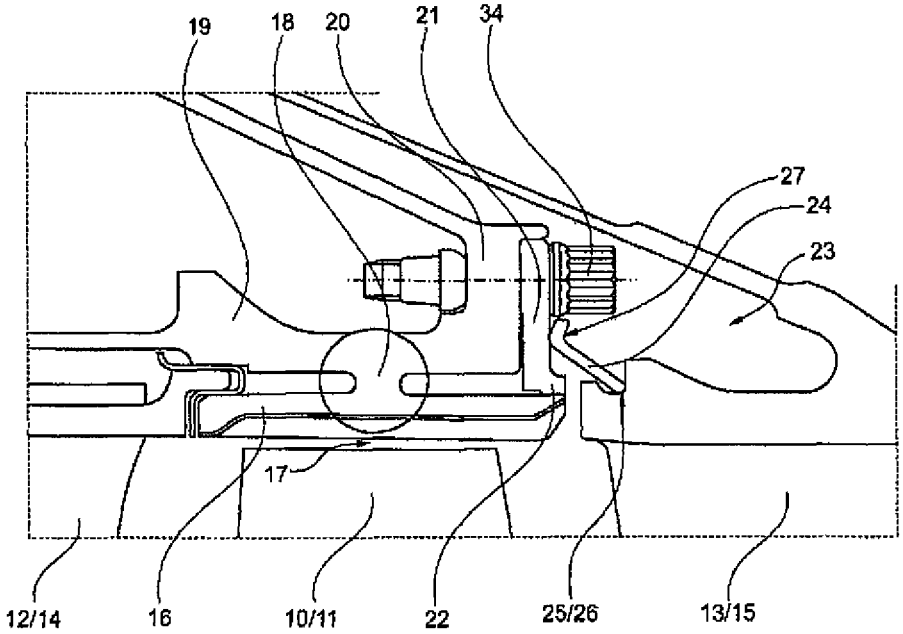
FIG. 1 shows a detail of a turbomachine in the area of a housing-side structure of same according to a first exemplary embodiment of the present invention.

FIG. 1 shows a detail of a turbomachine in the area of a housing-side structure of a compressor according to a first exemplary embodiment of the present invention, FIG. 1 showing a rotor-side moving blade ring 10 having moving blades 11, and showing stator-side guide blade rings 12 and 13 having guide blades 14 and 15 upstream and downstream from moving blade ring 10. Such a compressor may be designed with a longitudinal division or with a transverse division.

A jacket ring 16, which functions as the carrier for an abradable lining for the radially outer ends of rotor-side moving blades 11 of moving blade ring 10 and which together with same defines a clearance 17, is radially adjacent to moving blade ring 10 and the moving blades 11 of same on the outside.

To ensure clearance control of clearance 17 between the radially outer ends of moving blades 11 of moving blade ring 10 and jacket ring 16 using simple structural means, jacket ring 16 of the housing-side structure is connected to a stator-side housing part 19 which is radially adjacent to jacket ring 16 on the outside, forming at least one constriction 18 and is thermally decoupled from same as well as from the rest of the housing. In FIG. 1 constriction 18 is positioned centrally in relation to jacket ring 16, although constriction 18 may preferably be situated up to the upstream first third of the jacket ring 16.

A flange 20 to which a supporting element 21 is attached is formed on this stator-side housing part 19 which is radially connected to jacket ring 16 on the outside and is connected to same via constriction 18 in the exemplary embodiment in FIG. 1, this supporting element being in contact with a section 22 on the downstream end of jacket ring 16 in FIG. 1 for stabilization and in particular for sealing of same. Tilting of jacket ring 16 may be prevented via supporting element 21.

In the exemplary embodiment shown in FIG. 1, section 22 of supporting element 21, with which this section is in contact with jacket ring 16 for stabilizing and in particular for sealing this section, extends essentially in the horizontal, i.e., axial, direction, so that, with a surface which extends essentially in the horizontal, i.e., axial, direction, this section 22 is in contact with a surface of jacket ring 16, which also extends essentially in the horizontal, i.e., axial, direction, forming a sealing area and thus a sealing function.

According to FIG. 1, supporting element 21 is attached to flange 20 of housing part 19 via fastening elements 34, which are formed in particular as screw elements. Multiple fastening elements 34 are distributed over the circumference of supporting element 21.

Supporting element 21 is preferably designed as a segmented ring.

To prevent an inflow of hot gas from the flow channel of the turbomachine into a housing-side recess 23, the housing-side structure of the turbomachine also has a heat shield 24, heat shield 24 engaging at a first end 25 in a recess 26 of a stator-side component, which is connected downstream to jacket ring 16, namely engaging in recess 26 of a guide blade 15 according to FIG. 1, and heat shield 24 being in contact at a second end 27 with supporting element 21, which functions to stabilize and in particular to seal jacket ring 16. Heat shield 24 is preferably designed as a metal ring.

Figure 2:
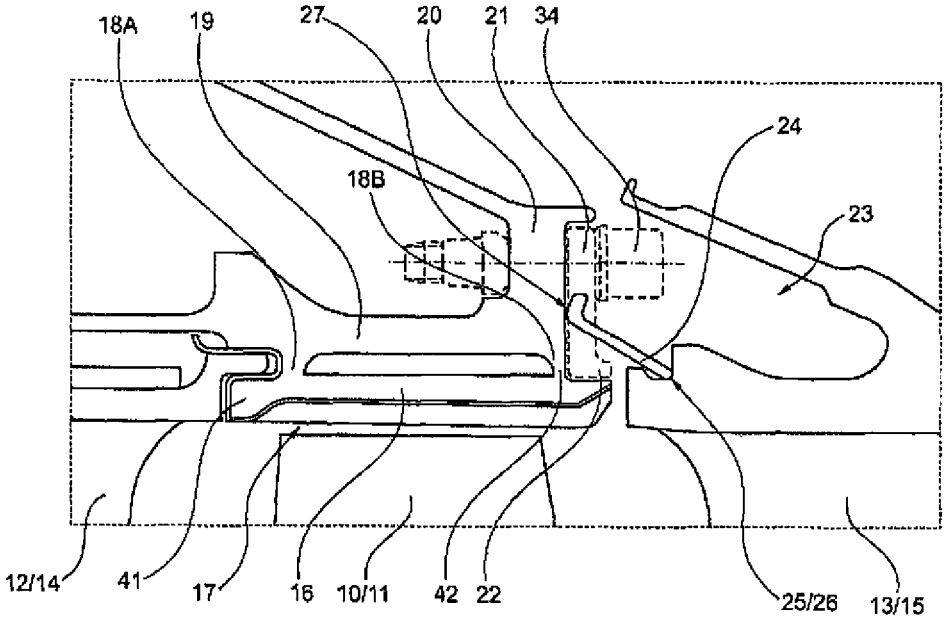
FIG. 2 shows a detail of a turbomachine in the area of a housing-side structure of same according to a second exemplary embodiment of the present invention.

FIG. 2 shows a second exemplary embodiment of a housing-side structure of a turbomachine according to the present invention, the exemplary embodiment of FIG. 2 corresponding essentially to the exemplary embodiment of FIG. 1, so that to avoid unnecessary repetition, the same reference numerals are used for the same assemblies and hereinafter only those details in which the exemplary embodiment according to FIG. 2 differs from the exemplary embodiment according to FIG. 1 are discussed below.

Two constrictions 18A and 18B are present in the exemplary embodiment of FIG. 2, connecting jacket ring 16, which carries the abradable lining, to stator-side housing part 19 which is radially adjacent to jacket ring 16 on the outside and thermally decoupled from same. As viewed in the axial direction, constrictions 18A and 18B are thus positioned off-center in relation to jacket ring 16, whereas in the exemplary embodiment of FIG. 1 constriction 18 is positioned centrally in relation to jacket ring 16 as viewed in the axial direction.

It is also possible to have only one eccentric constriction. It is thus possible for upstream constriction 18A to be present in the exemplary embodiment in FIG. 2, but not downstream constriction 18B.

As shown by a dashed line in the illustration of the exemplary embodiment in FIG. 2, supporting element 21 may be omitted in the exemplary embodiment in FIG. 2, in particular when downstream constriction 18B, which has a stabilizing effect, is present. Fastening element 34 may also be omitted in this case. Heat shield 24 is not in contact with supporting element 21 at its second end 27 in this case but instead is in contact with flange 20 of housing part 19.

Figure 3:
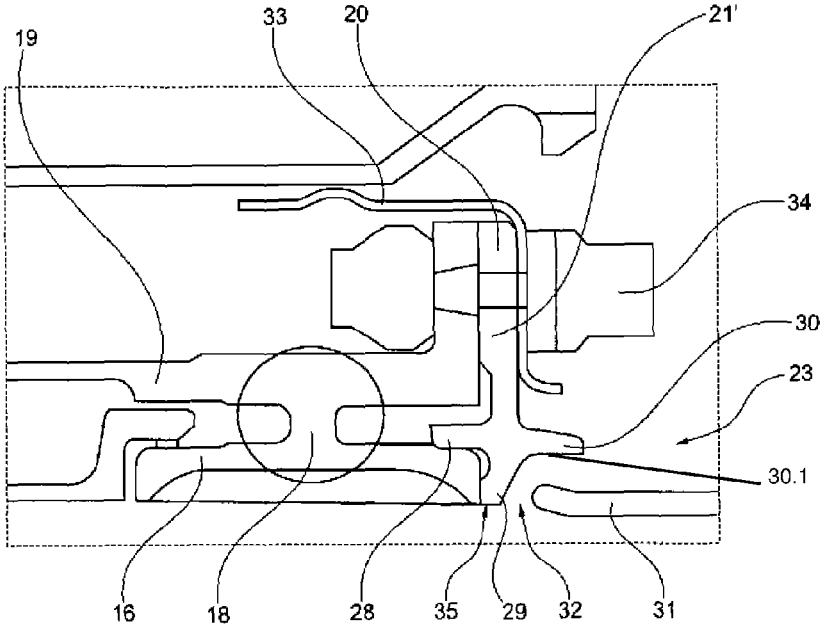
FIG. 3 shows a detail of a turbomachine in the area of a housing-side structure of same according to a third exemplary embodiment of the present invention.

FIG. 3 shows a third exemplary embodiment of a housing-side structure of a turbomachine according to the present invention, a supporting element 2P again being present in the exemplary embodiment in FIG. 3, which stabilizes and in particular seals jacket ring 16 and is mounted on flange 20, which is formed on housing part 19, which is connected to jacket ring 16 via constriction 18. Constriction 18 again provides thermal decoupling of jacket ring 16 from housing part 19.

In the exemplary embodiment in FIG. 3, supporting element 21' is in contact with the downstream end of jacket ring 16 in two sections 28 and 29, namely with a first section 28 extending essentially in the horizontal, i.e., axial, direction, and a section 29 extending essentially in the vertical, i.e., radial, direction. Section 28 of supporting element 21' extending essentially in the horizontal, i.e., axial, direction is in contact with a surface of jacket ring 16, which also extends essentially in the horizontal, i.e., axial, direction, whereas section 29 is in contact with a section of jacket ring 16 extending essentially in the vertical, i.e., radial, direction. These sections 28, 29 are used in particular for stabilizing and sealing jacket ring 16.

In the exemplary embodiment in FIG. 3, another section 30 is formed on supporting element 21', which also extends essentially in the axial, i.e., horizontal, direction and protrudes with respect to jacket ring 16 in the downstream direction and covers a stator-side component 31 in some sections which is radially connected downstream to jacket ring 16 on the outside.

In thermal expansion of component 31 during operation, the latter comes to rest against stop 30.1 on section 30 of supporting element 21', therefore preventing hot gas from the flow channel from flowing into a housing-side recess through a clearance 32 formed between supporting element 21 and component 31. This component 31 may be a section of a stator-side guide blade ring or a stator-side flow channel section.

A radially inner contour 35 of section 29 of supporting element 21' which restrains a flow channel radially on the outside in some sections, namely in the transitional zone to component 31, is designed and contoured in such a way that this contour deflects a gas stream radially toward the inside and thus prevents or greatly reduces the inflow of hot gas through clearance 32 into housing-side recess 23.

A heat shield 33 is also present in the exemplary embodiment in FIG. 3, but in contrast with the exemplary embodiment in FIG. 1, it is mounted on flange 20 together with supporting element 21'. Heat shield 33 in FIG. 3 also prevents a hot gas inflow into a housing-side recess. Heat shield 33 is preferably designed as a metal ring.

An effective and reliable clearance control between the radially outer ends of the moving blades of a moving blade ring and a jacket ring 16 radially connected on the outside may be ensured in a structurally simple manner using the present invention. Jacket ring 16 is thermally decoupled from the housing via at least one constriction 18, 18A, 18B.

Tilting of jacket ring 16 is preferably prevented by a supporting element 21 or 21' which mechanically stabilizes jacket ring 16 and seals it in particular against a hot gas inflow.

Clearance control may be further improved by an additional heat shield 24 or 33.

What is claimed is:

1. A housing-side structure of a turbomachine comprising:

a stator side housing part, a flange, and a jacket ring formed as a single piece;

the jacket ring having an inner side and an outer side opposite the inner side, the inner side carrying an abradable lining;

at least one constriction formed between the stator-side housing part and the jacket ring, the stator-side housing being opposite from and radially adjacent to the outer side of the jacket ring, the stator-side housing being thermally decoupled from the jacket ring via the at least one constriction, the flange being radially adjacent to the jacket ring; and a support fastened to the flange and in contact with a downstream end of the jacket ring for stabilizing the jacket ring, the support forming a seal with the downstream end of the jacket ring.

2. The housing-side structure as recited in claim 1 wherein the support is in contact via only one section of the support with the downstream end of the jacket ring, said one section extending in an axial direction.

3. The housing-side structure as recited in claim 2 further comprising an adjacent component, wherein a further section of the support protrudes with respect to the jacket ring in the downstream direction and forms a stop for the adjacent component, the stop being positioned such that the adjacent component comes to rest against the stop during a thermal expansion of the adjacent component.

4. The housing-side structure as recited in claim 1 wherein the support is in contact via a first section of the support with the downstream end of the jacket ring, the first section of the support extending in an axial direction, wherein the support is contact with the downstream end of the jacket ring via a second section of the support, the second section of the support extending in a radial direction.

5. The housing-side structure as recited in claim 4 wherein a further section of the support protrudes with respect to the jacket ring in the downstream direction and forms a stop for an adjacent component, the adjacent component coming to rest against the stop during a thermal expansion of the adjacent component.

6. The housing-side structure as recited in claim 1 further comprising a heat shield preventing a hot gas inflow into a housing-side recess.

7. The housing-side structure as recited in claim 6 wherein the heat shield contacts the support or the flange.

8. The housing-side structure as recited in claim 6 wherein the heat shield is inserted with a first end into a recess in a stator-side component connected downstream to the jacket ring, and, with a second end, is in contact with the support or the flange.

9. The housing-side structure as recited in claim 6 wherein the heat shield is designed as a metal ring.

10. The housing-side structure as recited in claim 1 further comprising a component adjacent to the jacket ring in the downstream direction.

11. The housing-side structure as recited in claim 1 wherein the jacket ring comprises a plurality of jacket ring segments.

12. The housing side structure as recited in claim 1 wherein the turbomachine is a gas turbine.

13. The housing-side structure of claim 1, wherein the at least one constriction is a single constriction.

14. The housing-side structure of claim 1, wherein the at least one constriction includes a pair of constrictions positioned off-center in relation to the jacket ring as viewed in the axial direction.

15. A turbomachine comprising:

a stator having a housing, the stator having guide blades; the stator including a stator side housing part, a flange and a jacket ring formed as a single piece at least one constriction formed between the stator-side housing part and the jacket ring, the stator-side housing being opposite from and radially adjacent to the outer side of the jacket ring, the flange being radially adjacent to the jacket ring;

a support fastened to the flange and in contact with a downstream end of the jacket ring for stabilizing the jacket ring, the support forming a seal with the downstream end of the jacket ring; and a rotor having moving blades forming at least one moving blade ring, the moving blade ring being radially adjacent to the jacket ring, and being surrounded by the jacket ring to define a clearance with the jacket ring, the jacket ring carrying an abradable lining, the abradable lining being opposite the radially outer ends of the rotor-side moving blades of the moving blade ring, the housing being thermally decoupled from the jacket ring via the at least one constriction.

16. The turbomachine recited in claim 15, wherein the turbomachine is a gas turbine.

17. The housing-side structure of claim 13, wherein the single constriction is positioned centrally in relation to the jacket ring as viewed in an axial direction.

18. A housing-side structure of a turbomachine comprising:

a stator side housing part, a flange, and a jacket ring formed as a single piece;

the jacket ring having an inner side and an outer side opposite the inner side, the inner side carrying an abradable lining; and a pair of constrictions formed between the stator-side housing part and the jacket ring, the stator-side housing being opposite from and radially adjacent to the outer side of the jacket ring, the stator-side housing being thermally decoupled from the jacket ring via the pair of constrictions, the pair of constrictions positioned off-center in relation to the jacket ring as viewed in the axial direction, the flange being radially adjacent to the jacket ring.

* * * * *